United States Patent [19]

Bosco

[11] 4,388,788

[45] Jun. 21, 1983

[54] WOOD FLOOR PANEL

[75] Inventor: Lewis R. Bosco, East Berlin, Pa.

[73] Assignee: Penn Wood Products Co., E. Berlin, Pa.

[21] Appl. No.: 174,141

[22] Filed: Jul. 31, 1980

[51] Int. Cl.[3] ..... E04F 13/08

[52] U.S. Cl. ..... 52/390; 52/586

[58] Field of Search ..... 52/390–586

[56] References Cited

U.S. PATENT DOCUMENTS

| | | | |
|---|---|---|---|
| 1,778,352 | 10/1928 | Bruce . | |
| 1,925,068 | 8/1933 | Gray . | |
| 1,991,701 | 2/1935 | Roman . | |
| 2,018,711 | 10/1935 | Elmendorf | 52/390 |
| 2,045,382 | 6/1936 | Elmendorf | 52/586 |
| 2,054,015 | 9/1936 | Bruce, Jr. . | |
| 3,118,804 | 1/1964 | Tibbals . | |
| 3,128,511 | 4/1964 | Tibbals . | |
| 3,554,850 | 1/1971 | Kuhle . | |
| 3,579,941 | 5/1971 | Tibbals | 52/390 |

FOREIGN PATENT DOCUMENTS

| | | | |
|---|---|---|---|
| 1263083 | 4/1961 | France . | |
| 546957 | 8/1956 | Italy . | |
| 183305 | 7/1922 | United Kingdom . | |
| 230712 | 3/1925 | United Kingdom . | |
| 278568 | 10/1927 | United Kingdom . | |
| 399983 | 10/1933 | United Kingdom . | |
| 448329 | 6/1936 | United Kingdom | 52/390 |
| 492953 | 9/1938 | United Kingdom . | |
| 500071 | 2/1939 | United Kingdom . | |
| 544228 | 4/1942 | United Kingdom | 52/390 |
| 570938 | 7/1945 | United Kingdom . | |
| 734179 | 7/1955 | United Kingdom . | |

*Primary Examiner*—John E. Murtagh

*Attorney, Agent, or Firm*—Stevens, Davis, Miller & Mosher

[57] ABSTRACT

A wood floor panel is disclosed comprising a plurality of substantially identical individual panel sections having bevels cut in their undersurface at the edges thereof such that when the sections are abutted together the bevel cuts of abutting sections form an adhesive well along which an adhesive bead is applied to fasten and hold the individual sections together. The panel may optionally be provided with tongues and grooves, each of which is cut along the entire length of a respective side edge thereof. Panels of various sizes can be formed using identical bevel cut panel sections which are merely arranged in the panel shape and size desired and fastened by the adhesive beads.

17 Claims, 10 Drawing Figures

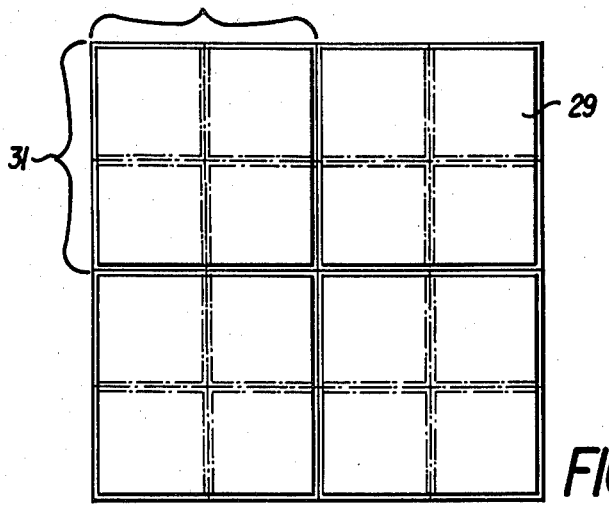
FIG. 8A
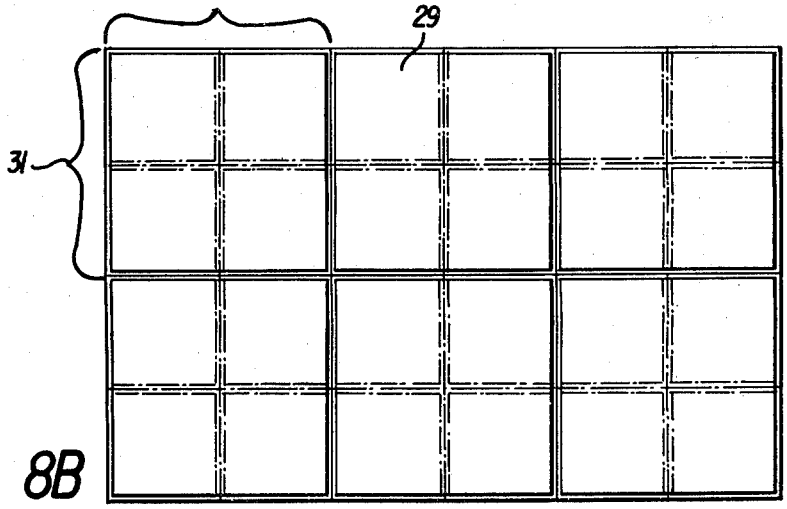
FIG. 8B
FIG. 8C
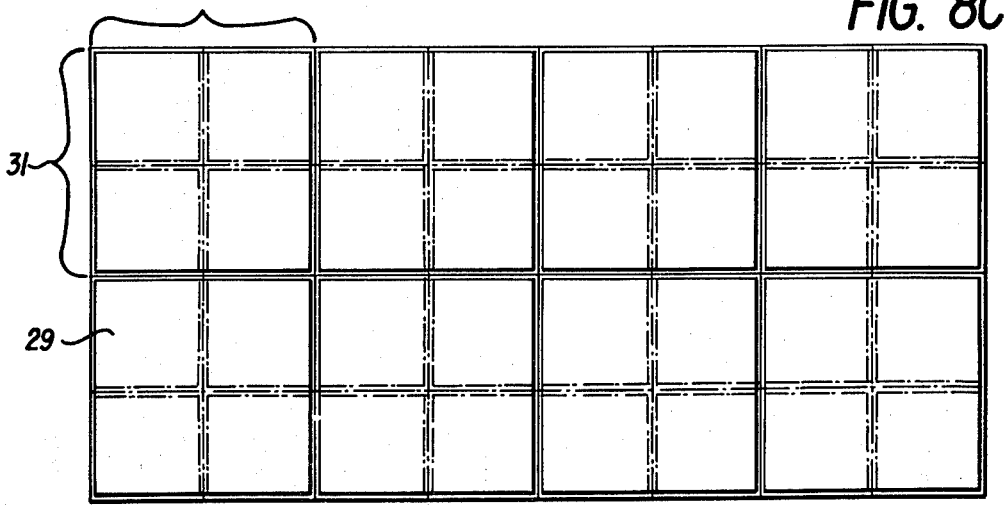

WOOD FLOOR PANEL

BACKGROUND OF THE INVENTION

The present invention relates to wood floor panels and is particularly directed to a unique wood floor panel which is formed from a plurality of substantially identical sections, each of which has a bevel cut from an undersurface thereof along each of its side edges, which bevel cuts form, at the abutment of two sections, an adhesive well for receiving an adhesive bead joining and firmly interconnecting the individual panel sections to form a completed floor panel unit. Since the panel sections are substantially identical, the wood panel of the invention is simply and easily constructed and is inexpensive to produce as expensive tongue and grooving of individual panel sections can be avoided. The completed floor panel may have a pair of tongues cut along the entire length of two side edges thereof with complementary grooves cut along the entire length of the remaining two side edges to enable an interlocking of the panel sections during installation on a floor substrate. Since all bevel cutting is done in the undersurface of the panel the wear or show surface is unaffected.

The adhesive wells formed by the bevel cuts of the individual sections can have a dimension relative to that of the adhesive bead applied therein to permit a significant amount of free area within and along the adhesive well which may receive an adhesive used for laying the floor, thus contributing to the positive retention of a floor panel set in place on a substrate.

Accordingly, an object of the invention is to provide a relative inexpensive yet reliably constructed wood floor panel formed of a plurality of substantially identical abutting panel sections, each section having a bevel undercut along the entire side edge periphery which forms, with a like bevel cut from an abutting section, an adhesive well which receives an adhesive bead to interconnect and hold the adjacent and abutting sections together to form a completed panel assembly.

An additional object of the invention is to provide wood floor panels of various sizes using any number of substantially identical panel sections having the bevel cut noted and interconnected by an adhesive bead as described in the preceding paragraph.

An additional object of the invention is to provide a floor panel which is more surely retained in place when set on a substrate due to the presence of recessed areas in the undersurface formed by a portion of the adhesive wells unoccupied by the adhesive bead which may be filled by an adhesive used to secure the wood floor panel to a substrate.

An additional object of the invention is to provide a wood floor panel formed of substantially identical interconnected sections as described above which has tongues provided along the entire length of two side edges and complimentary grooves provided along the entire length of the remaining two side edges to interlock the wood panels together during installation.

Yet another object of the invention is to provide a parquet floor panel which conforms more readily to substrate irregularities, provides a wearing surface comparable to other thin parquet floor blocks, and which provides for a reduced installation time.

An additional more specific object of the invention is to provide a parquet floor panel having a plurality of substantially identical abutting panel sections, each section formed of a plurality of finger-like wood strips interconnected by a plurality of restraining wires frictionally held in respective channels cut transversely to the length of the strips in the undersurface thereof, each section having the bevel cut described above and being interconnected with an adjacent abutting section by the above-described adhesive bead, each section being arranged such that the wood strips of one section are oriented perpendicularly to those of an abutting section and the panel having tongues cut along the entire length of two side edges and grooves cut along the remaining two side edges.

These and other objects, features and advantages of the invention will be more readily ascertained from the detailed description thereof which follows which is provided in conjunction with the accompanying drawings.

DETAILED DESCRIPTION OF THE DRAWINGS

Figure 1:
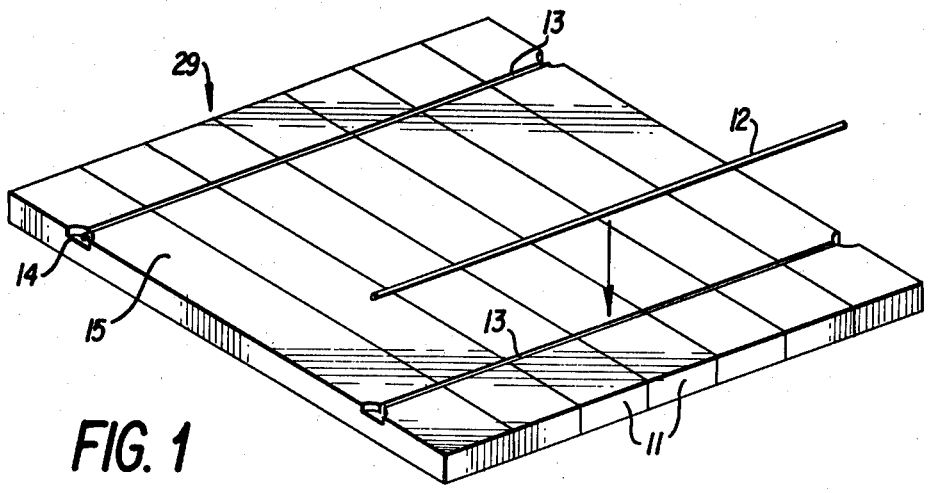
FIG. 1 illustrates in perspective view the underside of an individual panel section used to construct a wood floor panel of the invention.

FIGS. 8A, 8B and 8C respectively illustrate floor panels of the invention constructed from differing numbers of individual panel sections.

DETAILED DESCRIPTION OF THE INVENTION

The wood floor panel of the invention is constructed from a plurality of substantially identical panel sections 29. These panel sections are illustrated in a preliminary stage of finishing in FIG. 1. Each section 29 may include a plurality of substantially identical solid wood strips or slats 11 which are arranged side by side and held together by a wire 12 frictionally engaged in a respective channel 13 which is cut into the underside of the strips 11 in a direction transverse to the strip length. The wire is preferably an aluminum wire.

The method of manufacturing a wood panel as shown in FIG. 1 by interconnecting a plurality of wood strips with wires frictionally engaged in transverse channels in an undersurface thereof and the machinery therefor is disclosed in Tibbals U.S. Pat. Nos. 3,118,804 and 3,128,511; accordingly, a further discussion of the section 29 illustrated in FIG. 1 and its method of manufacture is deemed unnecessary.

During manufacture of the sections 29 illustrated in FIG. 1, the abutted strips 11 and interconnecting wires 12 are provided in a continuous stream on a conveyor over a plurality of panel sections. To separate the sections one from another a router bit is used to periodically drill through the wires 12 (thus forming depressions 14 in sections 29).

Figure 2:
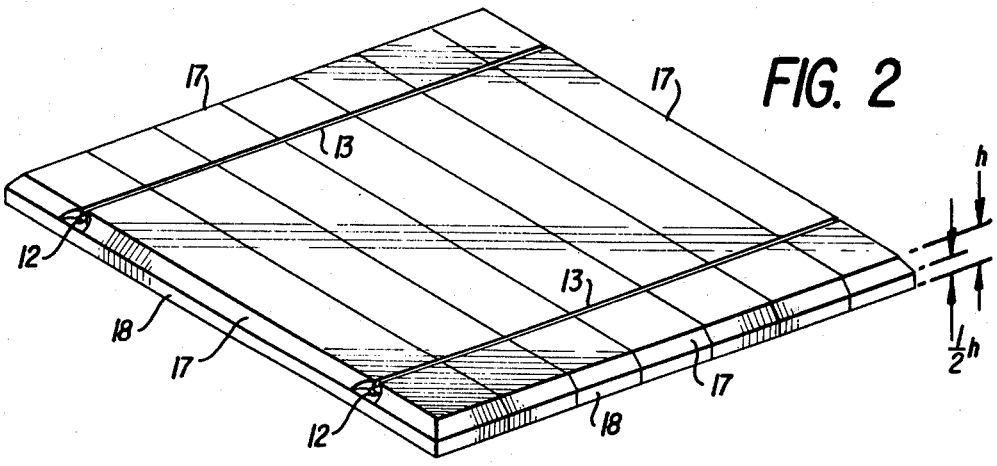
FIG. 2 illustrates the panel section of FIG. 1 with a bevel cut in the undersurface thereof on all four side edges.

The individual sections 29 illustrated in FIG. 1 are provided with a bevel cut in the undersurface thereof on all four edges 18 producing a bevel 17 on each of the edges, as illustrated in FIG. 2. The bevel cut begins at the undersurface of the sections, which is the illustrated upper surface throughout the drawing figures, and extends toward the wear or finish surface of the sections 29. The bevel extends to a depth of approximately one half of the thickness of the panel section 29, as illustrated in the right most portion of FIG. 2. The bevels 17 are preferably cut at a 45° angle to the plane of the undersurface of the panel sections 29 to provide a large surface area for an adhesive bead to bond to as the adhesive bead will provide the only means of interconnecting the individual sections 29.

Figure 3:
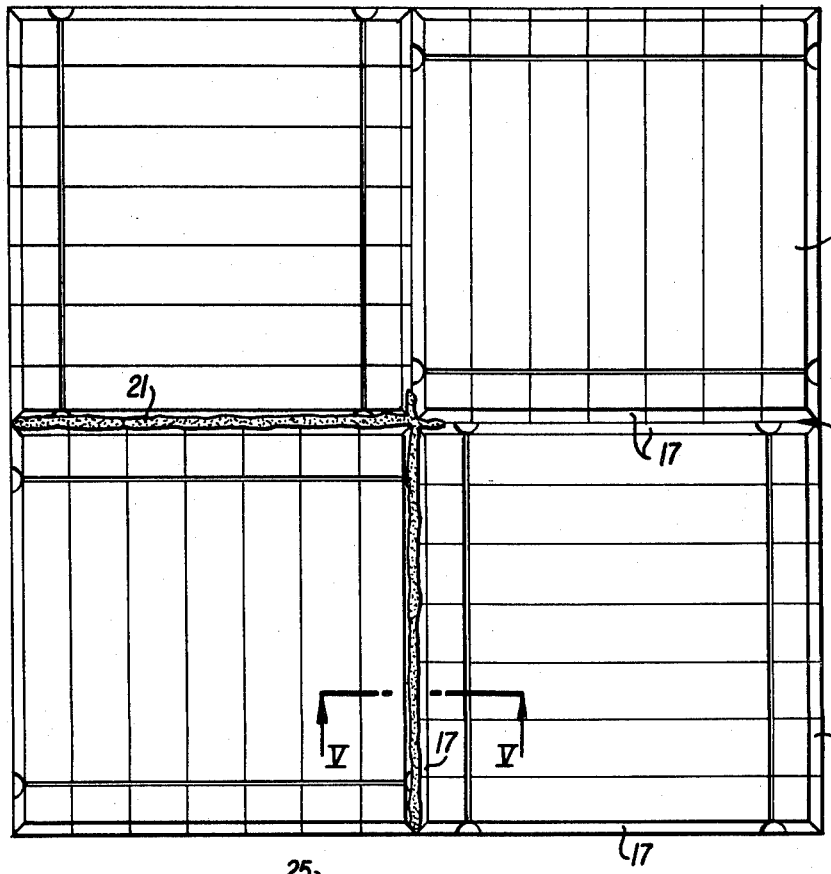
FIG. 3 illustrates in bottom view a floor panel of the invention constructed using the panel sections of FIG. 2.
Figure 4:
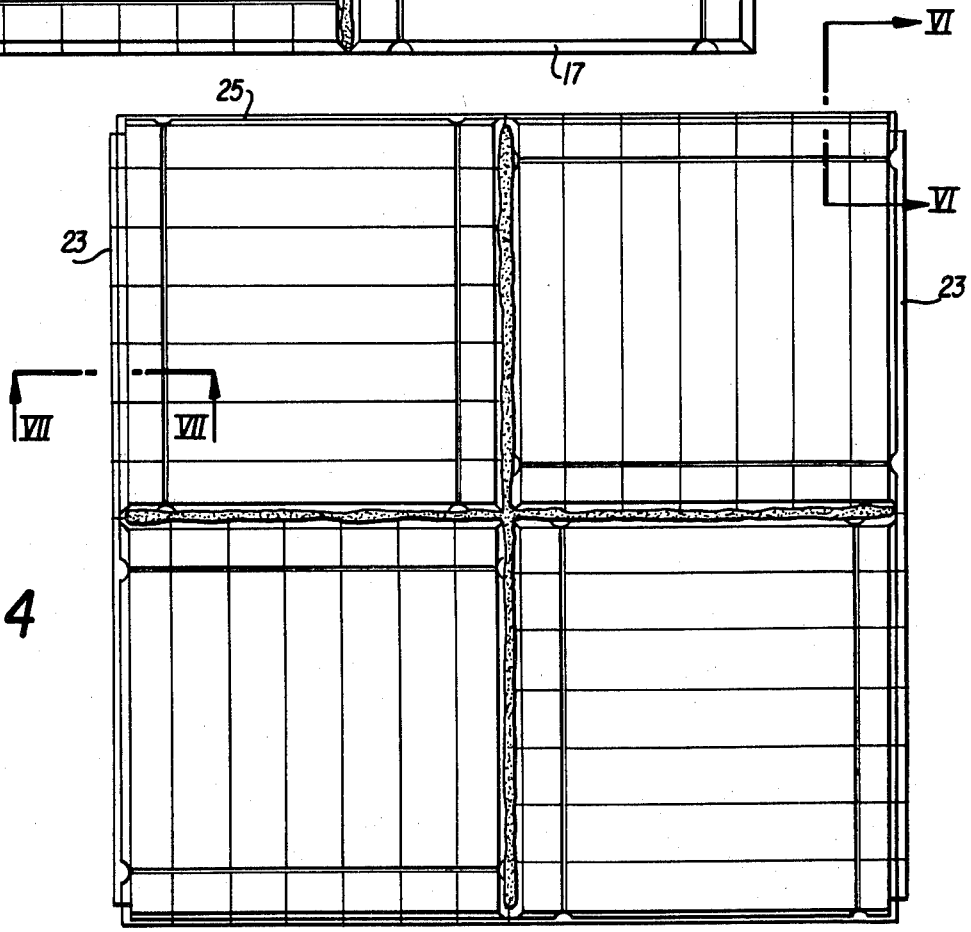
FIG. 4 illustrates the floor panel of FIG. 3 provided with tongues on two opposite side edges and grooves on the remaining two opposite side edges.

A plurality of bevel cut panel sections 29 (four being illustrated in FIGS. 3 and 4) are abutted together in the manner illustrated in FIG. 3. The bevel 17 cut in the undersurface at the edge of each of the panel sections forms, together with a like bevel from the edge of an abutting section, an adhesive well 19. For the purposes of illustration, a parquet floor panel is shown in FIGS. 3 and 4 in which the strips of adjacent panel sections are shown as perpendicular to each other. However, it should be understood the sections 29 can also assume other orientations in the floor panel wherein strips in adjacent sections might be in parallel.

The adhesive well 19 formed by abutting panel sections 29 is partially filled with an adhesive bead 21 running therealong, a portion of which is shown in FIG. 3, with the entire adhesive bead 21 for a panel being shown in FIG. 4. The adhesive is slightly flexible when set and is preferably a hot melt polyamid based adhesive. A polyamid based adhesive is preferred because it is less susceptible to cold fracture than other adhesives. One adhesive found to be particularly suitable is ethylvinylacetate. One such source for this adhesive is the H. B. Fuller Company under Item No. HM1474. The use of an adhesive which is slightly flexible when set permits a small amount of relative angular movement between interconnected sections in the finished panel which enables the panel to conform more closely with substrate irregularities. Since each of the panel sections 29 are formed of wire interconnected strips, as illustrated in FIGS. 1 and 2, the panel sections 29 will also be somewhat flexible and further enhance the ability of the completed panel to conform to substrate irregularities.

Figure 5:
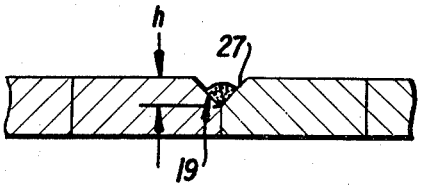
FIG. 5 is a sectional view taken along the lines V—V of FIG. 3.

The adhesive bead 21 is illustrated in greater detail in FIG. 5. It fills a good portion, but not all of, the cross section of adhesive well 19. As illustrated in FIG. 5, the width and depth of the adhesive well 19 is greater than the width and thickness of the bead 21 providing free areas 27 on either side of the adhesive bead and an additional free area between the top of the bead and planar undersurface of the sections 29. These areas are important and are left vacant to be filled with a conventional adhesive material used to mount the floor panel to a substrate. The mounting adhesive will ooze into these areas between the individual sections 29 of each panel to help hold the sections and panel in place. As further illustrated in FIG. 5, the panel sections 29 are simply edge abutted and glued in this position, thus simplifying manufacture of the individual sections as well as their assembly together in a floor panel.

Figure 6:
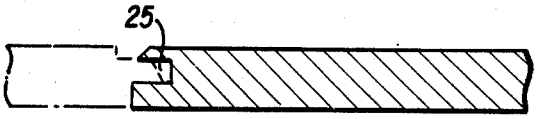
FIG. 6 is a sectional view taken along the lines VI—VI of FIG. 4.
Figure 7:
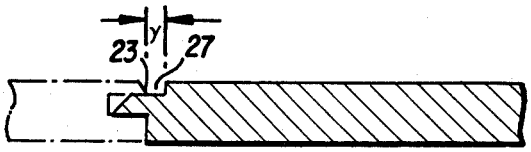
FIG. 7 is a sectional view taken along the lines VII—VII of FIG. 4.

FIG. 4 illustrates a further processing of the panel of FIG. 3. Here, tongues 23 have been cut into the opposite side edges of the FIG. 3 panel and grooves 25 have been cut in the remaining opposite side edges. The tongues and grooves extend along the entire length of a respective edge on which they are formed. Although the tongues 23 (and grooves 25) are provided on opposite side edges of the finished panel, they may also be provided on adjacent side edges forming a panel having a tongue, tongue, groove, and groove configuration along the respective four side edges. The grooves 25 are more particularly illustrated in FIG. 6 which is a sectional view of a portion of FIG. 4, while the tongues are illustrated in greater detail in FIG. 7. FIGS. 6 and 7 also show in dotted outline the side edge of an adjacent panel which may be interlocked with one of the panels of FIG. 4. Still further FIGS. 6 and 7 show a groove 27 which is provided so an adhesive material used to secure a panel in place may seep therein in a manner described above with respect to the adhesive wells 19 to further retain the wood panels in place. Groove 27 is provided by cutting the tongues 27 such that a greater depth Y (FIG. 7) is cut from the side edge of a panel in the panel undersurface side of the tongue than on the wear or show surface side thereof.

The completed floor panel illustrated in FIG. 4 may have its wear surface sanded and otherwise finished and stained as desired.

Thus far a floor panel has been illustrated formed from four panel sections. This panel may be conveniently formed in a 12"×12" size, with each individual section being approximately 6"×6". FIGS. 8A, 8B and 8C respectively illustrate floor panels formed of other numbers of sections 29. FIG. 8A illustrates a panel formed of 16 individual panel sections 29 or four large sections 31. The larger sections 31 can be formed as a single section such as illustrated in FIG. 2, or from a panel assembly such as illustrated in FIG. 3. In either case, all sections have the edge bevel cuts 17 forming adhesive wells and the adhesive beads 21 at their point of abutment with other sections. The FIG. 8A panel could be conveniently formed in a 24"×24" overall size, with each of the sections 31 being 12"×12" and including a total of 16 smaller sections. FIGS. 8B and 8C respectively illustrate a panel similar to that of FIG. 8A but formed in an overall respective size of 24"×36" containing 24 smaller panel sections and 24"×48" containing 32 smaller panel sections. FIGS. 8A, 8B, 8C show wood floor panels without tongues and grooves cut into their side edges, but these may be provided, if desired, being cut in the same manner the tongues 23 and grooves 25 illustrated in FIGS. 4, 6 and 7.

From the above, it should be evident that a floor panel of the invention is composed of a plurality of substantially identical panel sections which are bevel cut such that abutting adjacent sections form an adhesive well in which an adhesive bead may be set to interconnect and hold the individual sections into a finished panel. Tongues and grooves may be optionally provided on the entire length of the side edges of the finished panel.

Although the bevel 17 illustrated in FIG. 2 is cut at a substantially 45° angle, other angles may also be used and, other types of bevel cuts may also be used as side edge profiles such as L-shaped cuts, curved cuts, etc., the important characteristic of the panel section side profile being that it forms together with a like profile from an abutting adjacent panel section an adhesive well which receives an adhesive bead contacting both abutting panel sections.

Although each of the sections 29 have been illustrated as including a plurality of wood strips 11 held togehter by wires 12, it should be understood that the panel sections may be formed as a solid piece of wood or of subsections other than the strips 11 illustrated in FIGS. 1 and 2 depending on the overall wood pattern effect desired in the finished panel. Also, although generally square panel sections have been shown, other shapes such as rectangles, triangles, etc., can be used. Likewise, although square and rectangular floor panels have been shown, other shapes can also be used.

From the above, it should be evident that the floor panel illustrated and described is easily manufactured. The sections 29 are first formed and each is then subjected to a cutting and trimming operation to form the bevels 17 on each of the side edges, which trimming may also produce a slight shortening of the overall length and width dimensions of the sections 29. Following the beveling operation, the individual sections 29 are arranged and held in abuttment to form the particular wood panel desired and the adhesive bead is applied to the adhesive well formed by the abutting sections. The thus interconnected sections forming a panel may then be cut to form tongues and grooves along the entire length of the side edges to provide a means to interlock individual panels together, if desired.

Although particular embodiments of the invention have been described, it is to be understood that many modifications can be made to the invention without departing from the spirit and scope thereof. Accordingly, the invention is not to be limited by the foregoing description, but is limited solely by the claims which are appended hereto.

What is claimed is:

1. A wood floor panel having a top wear surface, an undersurface for mating with a substrate and four side edges comprising:

a plurality of wood panel sections each having a top wear surface, an undersurface, and side edges, each said panel section including a plurality of substantially identical solid wood strips arranged in parallel side by side relationship and interconnected by at least two wires frictionally engaged in respective channels provided in the undersurface of and extending transversely to the strips of said sections, each said panel section abutting at a side edge thereof with a side edge of an adjacent panel section and the area of abutment of adjacent panel sections including an adhesive well formed in the undersurface of said panel sections, an adhesive bead provided in each of said adhesive wells for interconnecting and holding said abutting panel sections together, and tongues provided along the entire length of two side edges of said panel and complementary grooves provided along the entire length of the remaining two side edges of said panel.

2. A wood floor panel having a top wear surface, and undersurface for mating with a substrate and four side edges comprising:

a plurality of wood panel sections having a top wear surface, an undersurface, and four side edges having flat portions, each said panel section abutting at a flat portion of at least two adjacent side edges thereof with a respective flat portion of side edges of adjacent panel sections, the abutment of panel sections at the flat portions of the side edges thereof being the sole point of contact between adjacent panel sections, the area of abutment of adjacent panel sections including an adhesive well on the undersurface of said panel sections, an adhesive bead provided in each of said adhesive wells for interconnecting and holding said abutting panel sections together, and tongues provided along the entire length of two side edges of said panel and complementary grooves provided along the entire length of the remaining two side edges of said panel.

3. A floor panel having a top wear surface, an undersurface for mating with a substrate, and four side edges comprising:

a plurality of panel sections having a top wear surface, an undersurface, and four side edges having flat portions, each said panel section abutting at a flat portion of at least two adjacent side edges thereof with a respective flat portion of side edges of adjacent panel sections, the abutment of panel sections at the flat portions of the side edges thereof being the sole point of contact between adjacent panel sections, the area of abutment of adjacent panel sections including an adhesive well on the undersurface of said panel sections, an adhesive bead provided in each of said adhesive wells for interconnecting and holding said abutting panel sections together, and tongues provided along the entire length of two side edges of said panel and complementary grooves provided along the entire length of the remaining two side edges of said panel.

4. A floor panel as in claims 1, 2 or 3 wherein said panel sections are square and said floor panel is square.

5. A floor panel as in claims 1, 2 or 3 wherein said adhesive well is formed by a bevel cut along an undersurface of the abutting edges of each of said panel sections at an angle of approximately 45° to the undersurface plane of each said section, the depth of penetration of said bevel from the undersurface toward the wear surface of a panel section being approximately one half of the thickness of said panel section.

6. A floor panel as in claim 5 wherein said adhesive bead has a thickness less than the depth of said adhesive wells formed by the bevel cuts of adjacent panel sections.

7. A floor panel as in claim 5 wherein the adhesive well formed by the beveled sides of abutting panel sections has a width greater than that of said adhesive bead to provide a well for an adhesive used to mount said panel to a substrate.

8. A floor panel as in claim 1 wherein the wood strips of each panel section are arranged perpendicularly to the wood strips of an abutting panel section.

9. A floor panel as in claims 1, 2 or 3 wherein said tongues are provided on opposite side edges of said panel and said grooves are provided on the remaining opposite side edges of said panel.

10. A floor panel as in claims 1, 2 or 3 wherein each panel includes an even number of panel sections.

11. A floor panel as in claim 10 wherein each panel includes four panel sections.

12. A floor panel as in claim 10 wherein each panel includes sixteen panel sections.

13. A floor panel as in claim 10 wherein each panel includes twenty-four panel sections.

14. A floor panel as in claim 10 wherein each panel includes thirty-two panel sections.

15. A floor panel as in claims 1, 2 or 3 wherein said adhesive bead is slightly flexible when set.

16. A floor panel as in claim 15 wherein said adhesive bead is a hot melt adhesive.

17. A floor panel as in claim 16 wherein said adhesive bead is a polyamid based adhesive.

* * * * *